United States Patent [19]

Laviana

[11] Patent Number: 4,524,250

[45] Date of Patent: Jun. 18, 1985

[54] ADJUSTABLE STOP TIME SWITCH

[75] Inventor: Lawrence J. Laviana, Kensington, Conn.

[73] Assignee: M. H. Rhodes, Inc., Avon, Conn.

[21] Appl. No.: 562,175

[22] Filed: Dec. 16, 1983

[51] Int. Cl.[3] ..... H01H 7/00

[52] U.S. Cl. ..... 200/33 R; 174/66

[58] Field of Search ..... 200/33 R, 35 R, 35 W, 200/38 F, 297; 174/66; 220/241; 339/123

[56] References Cited

U.S. PATENT DOCUMENTS

| | | | |
|---|---|---|---|
| 3,043,923 | 7/1962 | Sonobe et al. | 200/33 R X |
| 3,067,298 | 12/1962 | Rose | 200/33 R X |
| 3,198,893 | 8/1965 | Mapelsden | 200/33 R X |
| 3,428,763 | 2/1969 | Eshleman et al. | 200/33 R |

FOREIGN PATENT DOCUMENTS

| | | | |
|---|---|---|---|
| 982200 | 1/1976 | Canada | 200/38 R |

*Primary Examiner*—G. P. Tolin

*Attorney, Agent, or Firm*—Hayes & Reinsmith

[57] ABSTRACT

An adjustable stop member is disclosed for establishing a presettable period of runout for an interval timer. The stop member includes a series of openings formed at a common radial distance from a timer setting shaft receiving aperture and a protruding stop. A face plate is provided for the timer with a time scale on the face plate which corresponds with the series of openings in the stop member. The stop member is mounted in adjusted overlying relation to the face plate with a preselected opening of the stop member receiving the face plate stud which cooperates with the timer setting shaft in maintaining the stop member and its protrusion in adjusted position whereby a knob on the timer setting shaft may be rotated into engagement with the stop member protrusion for setting the interval timer to a predetermined period of runout.

17 Claims, 9 Drawing Figures

ADJUSTABLE STOP TIME SWITCH

FIELD OF THE INVENTION

This invention generally relates to interval timers and particularly concerns an adjustment mechanism suited to be used with a spring wound interval timer for establishing a presettable period of runout to a timed-out position upon actuating a winding knob.

BACKGROUND OF THE INVENTION

There are a number of types of different interval timer mechanisms. Such mechanisms may provide for a single output such as an audible sound or the closing or opening of a pair of electrical contacts upon expiration of a predetermined timed interval. Many of these mechanisms have been used in the past with a presettable period of runout to a timed-out position by initiating an operation to be timed by a push button release or a pointer on a manually actuated winding knob drivingly connected to the timer mechanism. To limit the period of runout to a timed-out position for controlling a given operation, it has been customary to provide different timers each presettable to different maximum timed intervals or which are simply adjustable by the user to variable dial settings. However, a user having a one hour or two hour timer and desiring to repeatedly and reliably preset a longer timing cycle, by simply actuating a winding knob against a stop, will have need for a different timer. Such need may be reflected, for example, in an operation such as changing an energy conservation program in a public or commercial building.

SUMMARY OF THE INVENTION

This invention provides a new and improved stop adjustment mechanism for use with a spring wound interval timer. The stop adjustment mechanism of this invention is specifically designed to ensure that it is not easily changed by a user but is nonetheless adjustable for different applications requiring different given timing cycles to be repeatedly established by the timer. The timer includes a setting shaft extending through an aperture of a face plate attached to the timer. The face plate features a stud integrally fixed to protrude from an exposed side of the face plate. To adjust the timer for repeatedly establishing a desired time interval upon initiating operation of a given timing cycle, a stop member is mounted in overlying relation to the face plate with an aperture formed in the stop member corresponding to the face plate aperture for receiving the timer setting shaft. A plurality of stud receiving openings are formed in the stop member such that it may be positioned in different relative angular positions, whereby a protrusion formed to project from the stop member may be disposed in different preselected angular positions relative to the timed-out position of the setting shaft. A manual winding knob is mounted on the timer setting shaft and has an indicating pointer cooperating with a dial on the face plate for manually setting a desired timed cycle. The winding knob pointer is movable into interfering relation with the protrusion of the stop member, which is fixed in adjusted position, for initiating a desired preset runout cycle.

Other objects will be in part obvious and in part pointed out in more detail hereinafter.

A better understanding of the objects, advantages, features, properties and relations of the invention will be obtained from the following detailed description and accompanying drawings which set forth a certain illustrative embodiment and is indicative of the various way in which the principle of the invention is employed.

DETAILED DESCRIPTION OF A PREFERRED EMBODIMENT

Figure 1:
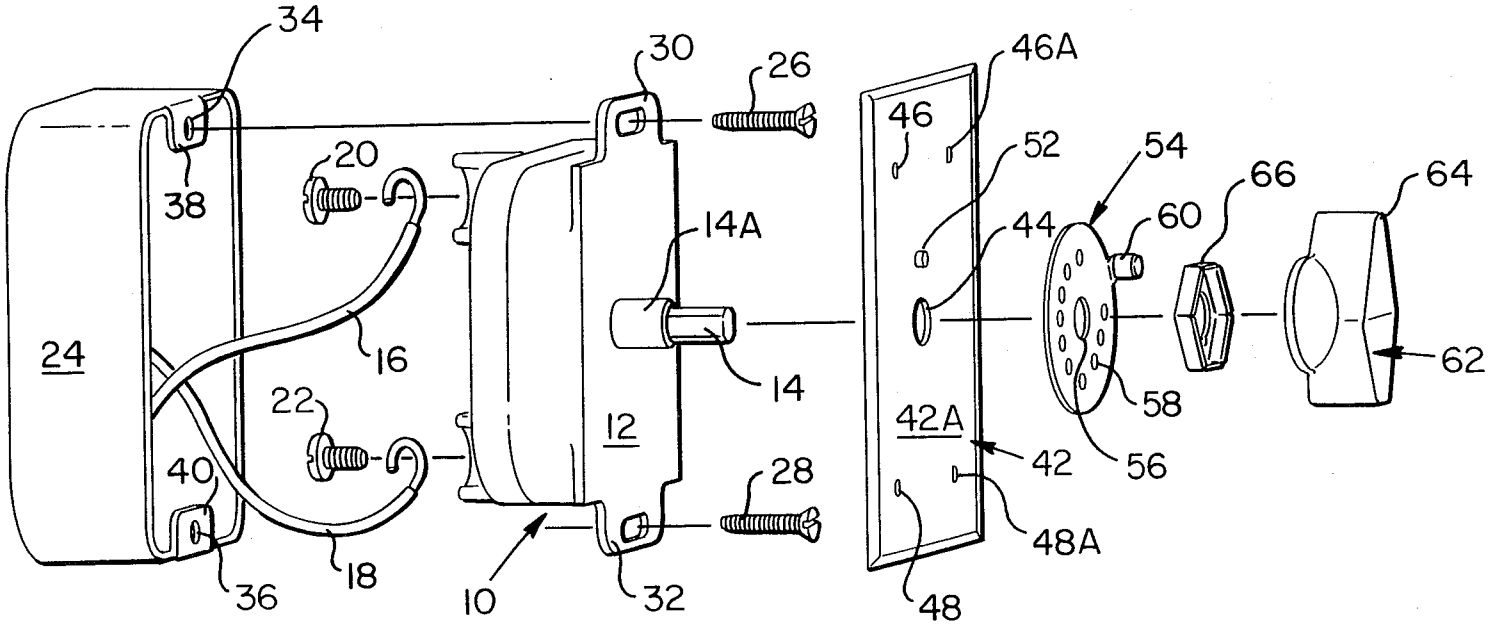
FIG. 1 is an exploded isometric view of an interval timer and time interval adjustment mechanism incorporating this invention.

FIG. 1 illustrates a timer 10 having a casing 12 within which is mounted a clock mechanism, not shown, which will be understood to have a conventional main spring and timer cam assembly which may be actuated by a setting shaft 14. Shaft 14 is rotatable clockwise from a timed-out position for winding the spring motor and is rotatable counter-clockwise by that spring motor during a period of runout to the timed-out position.

The timer mechanism may be provided for different purposes to serve as a time switch for a given operation. For example, a pair of electrical contacts, not shown, may be closed, upon clockwise movement of timer setting shaft 14 into a desired position for setting the clock mechanism, and remain closed during a period of runout. Upon reaching the timed-out position, the timer mechanism operates to move the contacts to an open position.

Casing 12 of the timer mechanism includes terminals, not shown, to which wires 16 and 18 are attached with terminal screws 20 and 22, and the wired timer 10 is then inserted into a suitable receptacle, such as the illustrated wall outlet box 24 and secured in position by a pair of screws 26, 28 extending through apertured straps 30, 32 on casing 12 and into openings 34, 36 in upper and lower ears 38, 40 on box 24.

To provide a time scale, a suitable dial is provided on an exposed side 42A of a wall or face plate 42 with time scale indicia, and plate 42 is provided with an aperture 44 to receive timer setting shaft 14.

Figure 3:
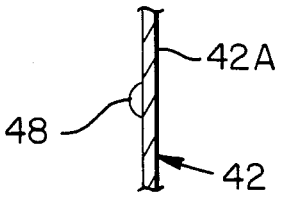
FIG. 3 is an enlarged sectional view taken generally along line 3—3 of FIG. 2.
Figure 4:
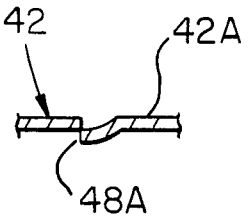
FIG. 4 is an enlarged sectional view taken generally along line 4—4 of FIG. 2.

To ensure that face plate 42 is positively maintained in properly aligned relation to outlet box 24 and timer casing 12, a plurality of openings 46, 46A and 48, 48A are formed in face plate 42 to provide detents extending in a direction opposite that of exposed side 42A of plate 42 for engagement with opposite sides of timer casing 12. As best seen in FIGS. 3 and 4, detents such as 48, 48A are formed to protrude and thus engage an adjacent side of casing 12 and restrain face plate 42 against undesired lateral movement relative to that casing such that face plate 42 is in retained properly aligned operative position relative to timer casing 12.

Figure 2:
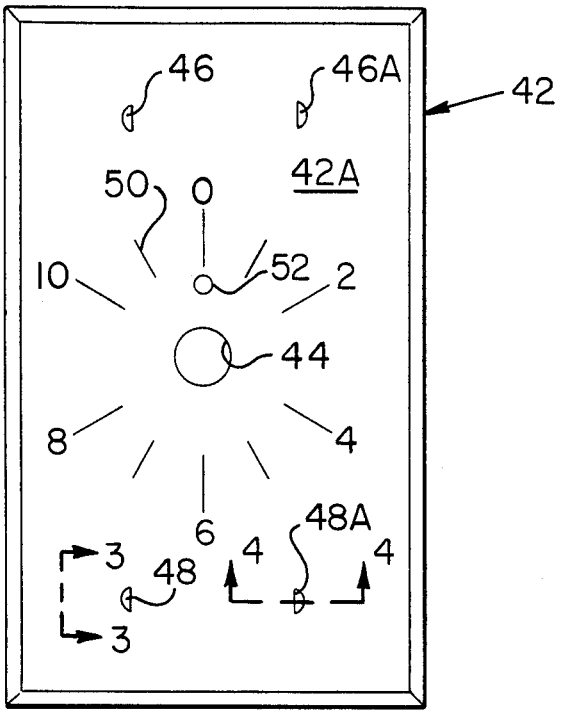
FIG. 2 is a plan view of a face plate used in the mechanism of FIG. 1.
Figure 5:
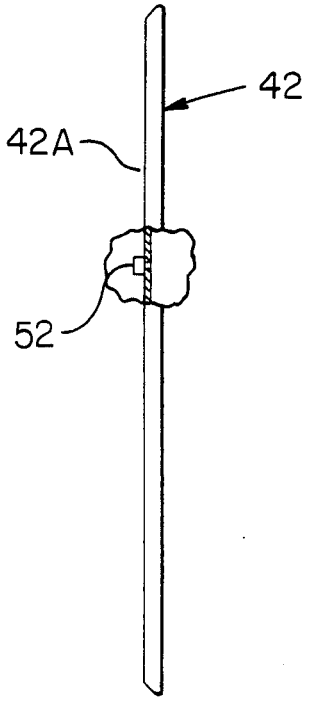
FIG. 5 is a side view, partly broken away and partly in section, of the plate of FIG. 2.

In the specifically illustrated embodiment, a timed-out position is indicated by the numeral zero which in the illustrated embodiment is at a twelve o'clock position (FIG. 2). The time scale for selecting the runout cycle is indicated on the dial by suitable indicia which in the illustrated embodiment is provided by equally spaced apart radial lines which emanate from the center of face plate aperture 44 with suitable numerals identifying alternate lines. A maximum time setting is at an eleven o'clock position which will be understood to be identified by a radial line 50 midway between lines identified by the number ten and numeral zero.

In accordance with one feature of this invention, a locating stud 52 is fixed to protrude from face plate 42 in radially aligned relation with the center of face plate aperture 44 and with the numeral zero at a predetermined radial distance from the center of face plate aperture 44 as best seen in FIG. 2. To provide adjustment of a presettable time cycle, while at the same time ensuring that the time cycle is not readily user adjustable, a stop member is provided in the form of a disk 54 shown mounted in overlying relation to face plate 42 and having an aperture 56 corresponding to face plate 44 aperture for receiving timer setting shaft 14 which will be understood to extend through both apertures 44, 56. A plurality of stud receiving openings such as at 58 are illustrated as being formed in disk 54 with the centers of each of the openings being located on an arc spaced from the center of disk aperture 56 at a radial distance which corresponds precisely to that of the predetermined radial distance at which locating stud 52 is disposed relative to the center of face plate aperture 44.

Figure 6:
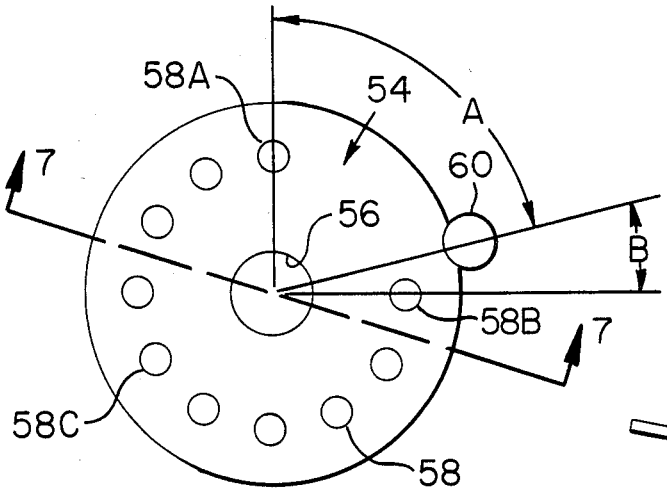
FIG. 6 is a plan view of a stop member used in the mechanism of FIG. 1.
Figure 7:
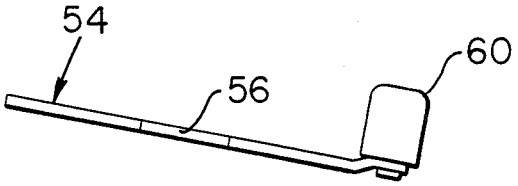
FIG. 7 is a sectional view taken generally along line of 7—7 of FIG. 6.

More specifically, in the illustrated embodiment, ten openings such as at 58 are formed in disk 54 with the centers of the openings equiangularly spaced apart along the arc in predetermined corresponding relation to the time scale indicating dial of the face plate 42. As best seen in FIGS. 6 and 7, disk 54 includes a protrusion or stop 60 staked to a rim of disk 54. Stop 60 is spaced apart in a clockwise direction, as viewed in the drawings, a preselected angular distance A from the center of stud receiving opening 58A of disk 54. The centers of the other stud receiving openings of disk 54 (FIG. 6) are located along the above mentioned arc extending in a counter-clockwise direction between opening 58A and stop 60 at a common radial distance from the center of disk aperture 56 and with the center of each disk opening being spaced at a common predetermined angular distance from the next adjacent disk opening.

In accordance with this invention, the common predetermined angular distance between adjacent disk openings 58 corresponds to adjacent time scale indicia noted above as being provided on the face of plate 42. As described, stop 60 is fixed to project from the rim of disk 54 radially outwardly of the arc on which the stud receiving openings 58 are located.

By virtue of the above described construction, a winding knob 62 may be readily mounted on timer setting shaft 14 in overlying non-interfering relation to disk 54 and locating stud 52, the knob 62 being provided with an indicating pointer 64 which cooperates with the face plate dail for indicating time. Accordingly, disk 54 may be adjustably fixed relative to the face plate dial upon first fitting disk 54 on face plate 42 before assembling knob 62, and by aligning a preselected hole 58 in the movable disk 54 with locating stud 52 so as to position stop 60 in spaced relation to the zero or timed out position on the dial at a desired time setting as indicated by indicia on the dial of face plate 42. The stop 60 of disk 54 preferably is not precisely aligned with the indicia but rather is at an offset angular distance B (FIGS. 6, 8 and 9) which compensates for indicating pointer 64 of the setting shaft winding knob 62 which then may be directed precisely toward indicia establishing a preselected time cycle as determined by the adjusted position of disk 54, upon manually moving the winding knob pointer 64 into engagement with the protruding stop 60 of the adjustable disk 54. To provide such engagement, the winding knob pointer 64 is dimensioned to extend beyond the stud receiving openings formed in disk 54 such that upon moving pointer 64 into engagement with stop 60, the spring motor is wound to initiate a predetermined period of runout indicated by the face plate dial.

When the adjustable disk 54 is angularly positioned with stop 60 in a desired location, it will be seen that the face plate stud 52 cooperates with the setting shaft 14 received in apertures 44 and 56 of face plate 42 and disk 54, respectively, for affixing disk 54 and its stop 60 in a predetermined angular position relative to face plate 42 with stop 60 of disk 54 being in interfering relation to the winding knob pointer 64 for setting a predetermined time runout cycle. Thereafter, the above mentioned components are preferably secured in assembled relation to one another by a self-threading nut 66 (FIG. 1) which is threadably engaged with an inner shank 14A of the timer mechanism setting shaft 14, and the manual knob 62 is then simply pushed onto shaft 14 to engage it with a friction fit and in registration with the timed-out position indicia on face plate 42 with the timer mechanism in its off position.

Figure 8:
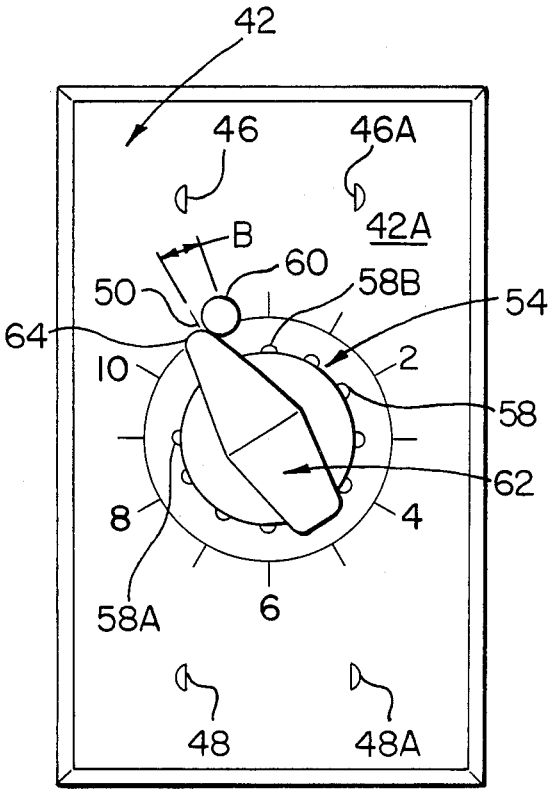
FIG. 8 is a plan view of the mechanism of FIG. 1 in assembled relation shown in an adjusted setting for a maximum timing cycle.
Figure 9:
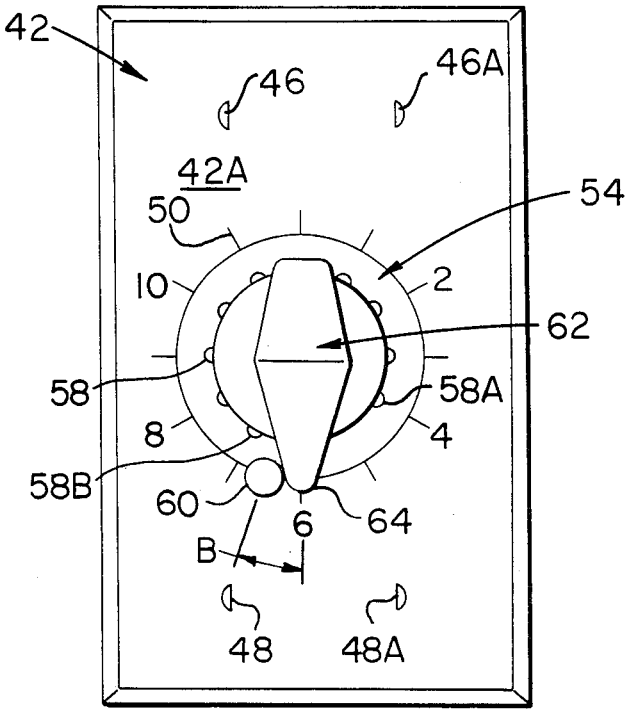
FIG. 9 is a view similar to FIG. 8 showing that mechanism in an adjusted setting different from that illustrated in FIG. 8.

Upon restoring power at a breaker or fuse panel, the timer 10 then may be operated. It will be noted that stop 60 and disk opening 58A, separated by the preselected angular distance A, cooperate to establish an adjusted minimum presettable period of runout when disk 54 is mounted with stud 52 received in disk 58A. Likewise, an adjusted maximum presettable period of runout is established when disk 54 is mounted with the face plate stud 52 received in disk opening 58B next adjacent stop 60. As illustrated, disk opening 58B is remotely disposed along the above mentioned arc from disk opening 58A (FIG. 8). Intermediate adjusted positions of disk 54 may be established to preset intermediate time runout cycles. For example, an intermediate setting is illustrated in FIG. 9 wherein disk opening 58C (FIG. 6) will be understood to receive stud 52 protruding from the face plate 42 such that stop 60 is in downstream adjacent relation to the time setting indicated by the numeral six whereby the winding knob 62 may be brought into engagement with stop 60, thereby to preset this particular desired period of runout.

As will be apparent to persons skilled in the art, various modifications, adaptations and variations of the foregoing specific disclosure can be made without departing from the teachings of this invention.

I claim:

1. A presettable time switch comprising an interval timer having a motor and setting shaft, the setting shaft rotatable in one angular direction from a timed-out position and rotatable by the motor in the opposite angular direction during a period of runout to the timed-out position, and a timed interval limit mechanism, the mechanism including a face plate attached to the timer and having a time scale indicating dial, an aperture receiving the timer setting shaft, and a stud fixed to protrude from the face plate at a predetermined radial distance from the center of the face plate aperture, a stop member mounted in overlying relation to the face plate and having an aperture corresponding to the face plate aperture and receiving the timer setting shaft, a plurality of stud receiving openings formed in the stop member, the centers of the stud receiving openings being located on an arc spaced from the center of the stop member aperture at said predetermined radial distance, and a protrusion projecting from the stop member, and a winding knob mounted on the timer setting shaft in overlying relation to the stop member, the winding knob having an indicating pointer cooperating with the dial for manually setting a desired time cycle, a preselected opening of the stop member receiving the face plate stud and cooperating with the setting shaft received in the stop member aperture for affixing the stop member and its protrusion in a preselected adjusted angular position relative to the face plate, the stop member protrusion located in interfering relation to the winding knob pointer for adjustably limiting timer runout as determined by the preselected adjusted position of the stop member upon the winding knob pointer being moved into engagement with the stop member protrusion.

2. The switch of claim 1 wherein the centers of the stud receiving openings of the stop member are equiangularly spaced apart along said arc in a predetermined corresponding relation to the time scale indicating dial of the face plate.

3. The switch of claim 2 wherein the protrusion on the stop member and its stud receiving openings are arranged such that the indicating pointer of the winding knob of the setting shaft may be directed to a preselected time indicator on the scale of the face plate, as determined by the adjusted position of the stop member, upon the winding knob pointer being moved into engagement with the stop member protrusion.

4. The switch of claim 1 wherein the protrusion is fixed radially outwardly of the arc on which the stud receiving openings are located in the stop member.

5. The switch of claim 4 wherein the winding knob pointer is dimensioned to extend beyond the stud receiving openings formed in the stop member such that the pointer is manually movable into engagement with the protrusion for winding the spring motor to effect a predetermined period of runout as determined by the time scale indicating dial of the face plate.

6. The switch of claim 1 wherein the face plate dial has indicia thereon for indicating the timed-out position and a given number of additional time indicating positions which are equally spaced apart from the adjacent time indicating position, the face plate dial indicia cooperating with the protrusion and winding knob pointer for establishing a predetermined time runout cycle.

7. The switch of claim 1 wherein the face plate includes a plurality of timer engaging detents projecting in a direction opposite an exposed side of the face plate for maintaining the face plate, the stop member and winding knob in predetermined operative relation of one another.

8. The switch of claim 1 further including a self-threading nut cooperating with the setting shaft for securing the stop member and the face plate in fixed relation.

9. The switch of claim 1 wherein the stud is fixed on the face plate in radial alignment with both the center of the face plate aperture and a zero time indicator on the face plate dial indicative of the timed-out position of the setting shaft.

10. The switch of claim 1 wherein the stop member comprises a disk with said protrusion projecting from a rim of the disk and defining a stop for the winding knob pointer.

11. The switch of claim 10 wherein the stop on the rim of the disk is spaced apart a preselected angular distance in a clockwise direction from the center of one of the stud receiving openings of the disk, wherein the centers of the other stud receiving openings are located between said one opening and the stop along said arc extending in a counter-clockwise direction from said one opening toward the stop with the center of each disk opening being spaced apart at a common predetermined angular distance from the next adjacent disk opening.

12. The switch of claim 11 wherein said common predetermined angular distance between adjacent disk openings corresponds to adjacent time scale indicia on the face plate.

13. The switch of claim 11 wherein said preselected angular distance between the stop and said one disk opening establishes an adjusted minimum preset period of runout when the disk is mounted with the face plate stud received in said one disk opening.

14. The switch of claim 11 wherein an adjusted maximum preset period of runout is established when the disk is mounted with the face plate stud received in a disk opening adjacent the stop and remotely disposed from said one disk opening along said arc.

15. A timed interval limit mechanism for use with a timer having a motor and setting shaft rotatable in one angular direction from a timed-out position and rotatable in the opposite angular direction during a period of timer runout to the timed-out position, the mechanism comprising a face plate, means for fixedly positioning the face plate relative to the timer, said face plate having a setting shaft receiving aperture and a stud fixed to protrude from the face plate at a predetermined radial distance from the center of the aperture, and a stop member mounted in overlying relation to the face plate and having a setting shaft receiving aperture corresponding to and aligned with the face plate aperture, a plurality of openings formed in the stop member selectively receiving the face plate stud, the centers of the stud receiving openings being located on the arc spaced from the center of the stop member aperture at said predetermined radial distance, and a protrusion projecting from the stop member, a preselected opening of the stop member receiving the face plate stud for affixing the stop member and its protrusion in a preselected angular position relative to the face plate and establishing the stop member protrusion in a predetermined position, and a winding knob removably assembled with the face plate and stop member to the timer setting shaft, the winding knob having an indicating pointer, the stop member protrusion being in interfering relation to the winding knob pointer for setting a predetermined time runout cycle.

16. The mechanism of claim 15 wherein the face plate includes a time scale indicating dial having a zero time indicator on the face plate indicative of a time-out timer condition, wherein the centers of the stud receiving openings of the stop member are equiangularly spaced apart along said arc in a predetermined corresponding relation to the time scale indicating dial, and wherein the stud on the face plate is fixed in radial alignment with both the center of the face plate aperture and the zero time indicator on the face plate dial.

17. The mechanism of claim 15 wherein the stop member comprises a disk with said protrusion projecting from a rim of the disk and defining a timer winding knob stop.

* * * * *